United States Patent [19]

Wolterstorff, Jr.

[11] Patent Number: 4,825,515

[45] Date of Patent: May 2, 1989

[54] SAFETY BUCKLE

[76] Inventor: Donald A. Wolterstorff, Jr., P.O. Box 533, Baraboo, Wis. 53913

[21] Appl. No.: 160,251

[22] Filed: Feb. 25, 1988

[51] Int. Cl.[4] ..... A44B 11/25

[52] U.S. Cl. ..... 24/625; 24/196; 24/615

[58] Field of Search ..... 24/625, 653, 615, 637, 24/313, 633, 171, 191, 196

[56] References Cited

U.S. PATENT DOCUMENTS

| | | | |
|---|---|---|---|
| 874,957 | 12/1907 | Godley | 24/615 |
| 3,812,556 | 5/1974 | Colombo | 24/653 |
| 4,025,991 | 5/1977 | Miner | 24/171 |
| 4,035,877 | 7/1977 | Brownson et al. | 24/171 |
| 4,150,464 | 4/1979 | Tracy | 24/196 |
| 4,662,040 | 5/1987 | Terrell et al. | 24/615 |
| 4,679,282 | 7/1987 | Feng | 24/615 |
| 4,712,280 | 12/1987 | Fildan | 24/615 |
| 4,727,630 | 3/1988 | Alan | 24/633 |

*Primary Examiner*—Victor N. Sakran
*Attorney, Agent, or Firm*—Carl E. Gulbrandsen

[57] ABSTRACT

A safety buckle which is comprised of two, releasable, interlocking portions. One portion has outward flexing lateral arms with tabs connected to their leading ends. Positioned between the lateral arms is a central safety arm which flexes vertically and has a latching hook connected to its leading end. The arms flex slightly to facilitate insertion into the receiving portion. When fully inserted the tabs of the lateral arm protrude into corresponding openings located on opposite sides of the receiving portion whereas the hook of the safety arm locks into a corresponding slot located on the back of the receiving poriton. Release of the interlocked portions is best accomplished by use of two hands; the thumb and first finger of one hand depressing the tabs of the lateral arms, and a finger of the other hand depressing the hook of the safety arm sufficient to permit release.

7 Claims, 3 Drawing Sheets

SAFETY BUCKLE

BACKGROUND OF THE INVENTION

The invention relates generally to a connector, and more particularly to a connector such as a buckle for joining together two ends of a belt or the like and includes a means to prevent acciental or uninvited release.

Connectors are conveniently used to join together two separate articles. Connectors such as buckles are usually used to join together belts or straps in conjunction with other equipment. Connectors or buckles comprised of two interlocking parts are desirable where it is necessary to quickly and securely join together two belts or straps. U.S. Pat. Nos. 4,025,991, 4,035,877, 4,150,464, and 4,282,634 disclose buckles comprised of two interlocking parts. Such buckles usually have a male and female part, the male part having a resilient member with a locking tab feature when the male part is inserted into the female part. In addition to providing for ease of union of two ends of a belt or strap, such construction as disclosed in the above-quoted patents permits easy one handed release of the interlocked male and female parts.

Easy release of the interlocked parts is not always a desirable feature, and some buckle designs have sought to guard against such easy release by the inclusion of separate locking means. U.S. Pat. Nos. 3,203,065, 3,795,030 and 3,203,065. The construction disclosed in these patents is complicated and does not lend itself to inexpensive manufacture.

SUMMARY OF THE INVENTION

The present invention is directed to an improved connector or buckle design which permits quickly, easy joining of the two ends of a belt or strap but has an additional locking feature which guards against unwanted release. As a specific example, to which no limitation is intended, this connector may be utilized with belts or straps in conjunction with children's strollers or high chairs. The connector is designed so that it is difficult to release the locking mechanism without the use of two hands. The connector is also designed so that once engaged a child of toddler age is unable to release the locking mechanism. Thus, the connector disclosed herein is designed to be resistant to uninvited release by a stranger or childish tampering which could cause accidental release.

Accordingly, it is a general object of this invention to provide a new and improved safety connector which is easily engaged but which has a locking feature to guard against unwanted or accidental release.

Another object of this invention is to provide a connector which is sturdy but simple in design, comprises few parts and yet accomplishes the above-described objectives in a reliable fashion.

Yet another object of this invention is to provide a connector which satisfies the foregoing objectives and is easy and inexpensive to manufacture.

The invention is of a connector which includes two releasable interlocking portions. One portion has lateral, outward flexing, latching arms which are designed to be inserted into a dimensionally corresponding receptacle in the other portion. The lateral latching arms have a tab attached to their leading end. The tabs permit a slight flexing to facilitate insertion. When the arms are fully inserted, the tabs protrude into openings formed in the other portion permitting outward flexing of the lateral latching arms engaging the portions. The invention further includes a flexible safety latching arm attached to one of the portions and positioned central to the lateral latching arms. The safety latching arm has attached to its leading end a latching hook. The hook permits slight flexing to facilitate insertion into the corresponding receptacle of the other portion. When the arm is fully inserted, the hook locks into a slot which conforms to the shape of the hook and is appropriately formed in the other portion. The openings and slot are designed to securely engage the tabs and safety hook and yet permit disengagement or release of a tab or hook by manually depressing it with a finger. The two lateral latching arms are designing for lateral bending, with the corresponding openings for the tabs of the lateral latching arms being located on opposite sides of the portion. Thus, release of the engaged lateral latching arm tabs may be accomplished by using the thumb and pointer finger of the same hand and with a pinching motion to depress the tabs sufficient to permit their release. The central latching arm is designed for vertical bending with the corresponding slot for the hook central latching arm being located on the back of the portion. Release of the locked hook of the central latching arm is accomplished by depressing the hook with a finger sufficient to permit its release. Simultaneous release of the engaged tabs and hook is thus best accomplished by using both hands: the one hand using the thumb and pointer finger to depress the engaged lateral latching arm tabs; the other hand using the pointer or middle finger to depress the engaged central latching arm hook. This feature guards against accidental or unwanted release of the interlocked portions. While providing additional safety, the central arm feature also limits the inward bending of the lateral latching arms to protect against over bending and breakage with frequent insertion or removal. Additional locking strength may be had with the present invention by substituting hooks for tabs on the lateral latching arms.

The novel features which are believed to be characteristic of the invention, both as to its organization and method of operation, together with further objectives and advantages thereof, will be better understood from the following drawings in which a presently preferred embodiment of the invention is illustrated by way of example. It is to be expressly understood, however, that the drawings are for the purpose of illustration and description only and are not intended as a definition of the limits of the invention.

DESCRIPTION OF THE PRESENTLY PREFERRED EMBODIMENT

An understanding of the present invention can be readily gained by reference to the drawings. The invention is of a connector or buckle which is easily joined but has a safety latching hook to prevent inadvertent or uninvited disengagement. The preferred embodiment of the invention is manufactured from a firm but flexible plastic material, but it is likely it could also be of another material such as a light metal. The invention is designed so that it could be easily molded in two parts but it could also be milled from a solid piece of appropriate material.

Figure 1:
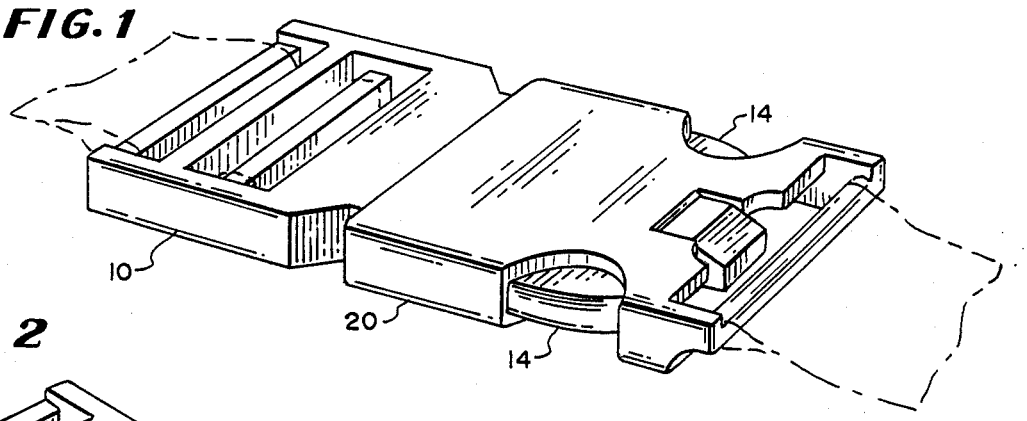
FIG. 1 is a pictorial view of the invention showing fully engaged portions.
Figure 2:
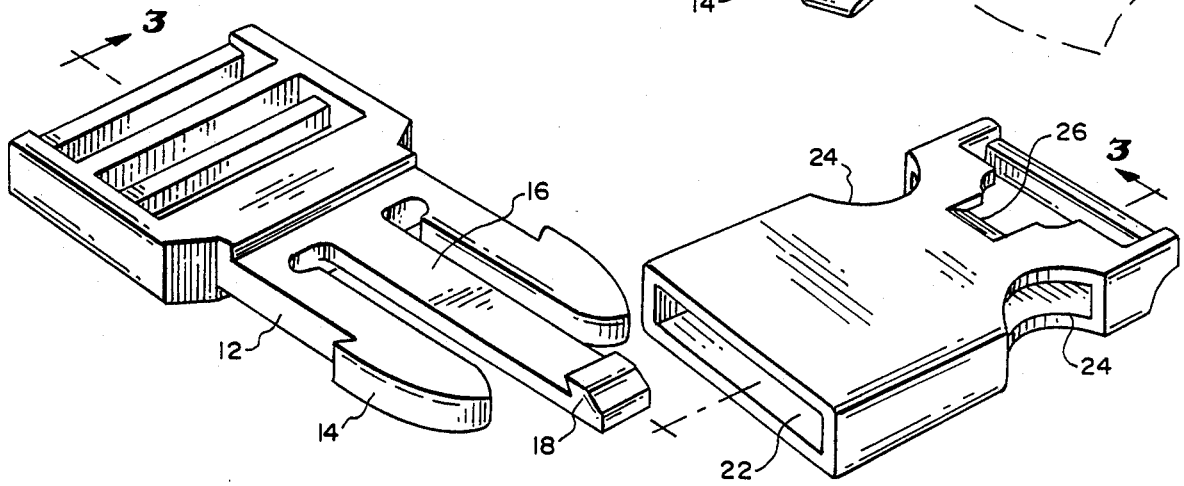
FIG. 2 is a pictorial view of the invention showing disengaged portions.
Figure 3:
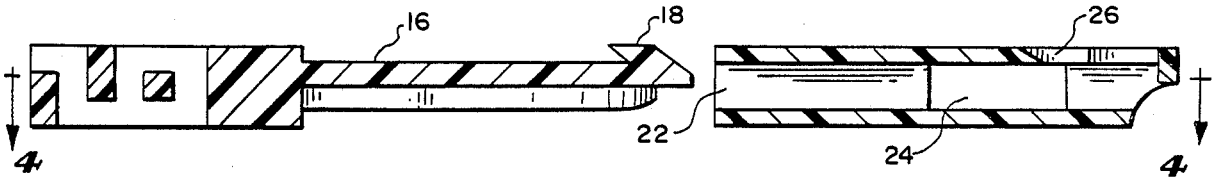
FIG. 3 is a cross-sectional view of the disengaged portions of the invention taken along line 3—3 of FIG. 2.
Figure 4:
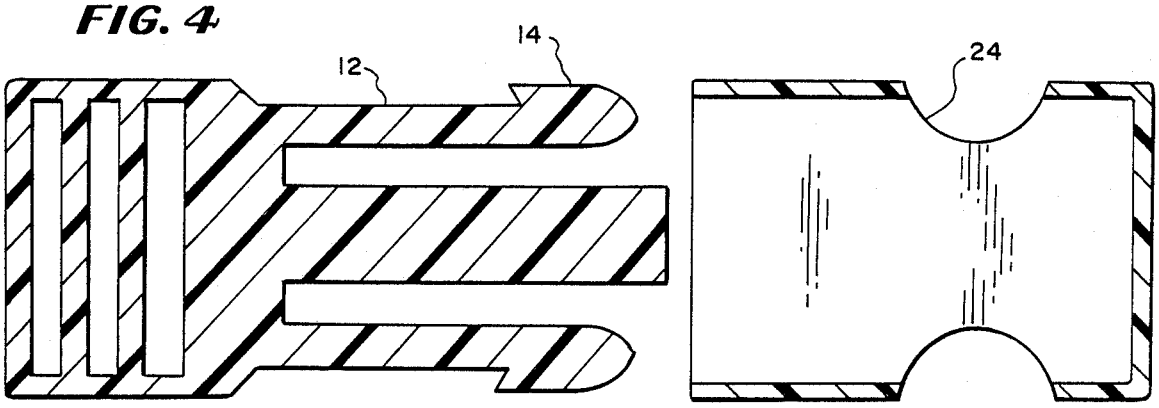
FIG. 4 is a cross-sectional view of the disengaged portions of the invention taken along line 4—4 of FIG. 3.
Figure 5:
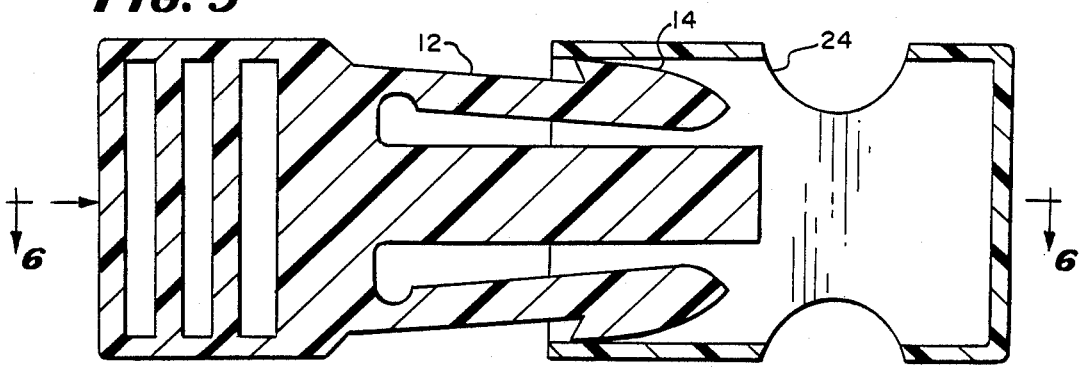
FIG. 5 is a cross-sectional view of partially engaged portions of the invention taken in the plane of line 4—4 of FIG. 3.
Figure 6:
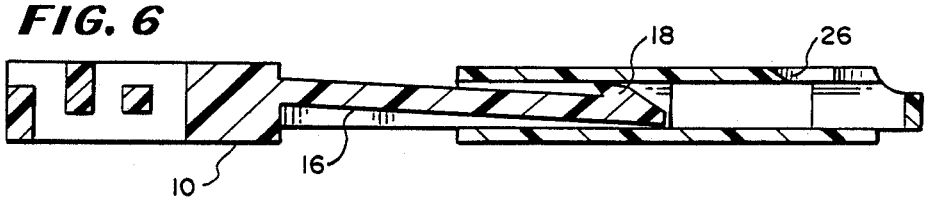
FIG. 6 is a cross-sectional view of partially engaged portions of the invention taken along line 6—6 of FIG. 5.
Figure 7:
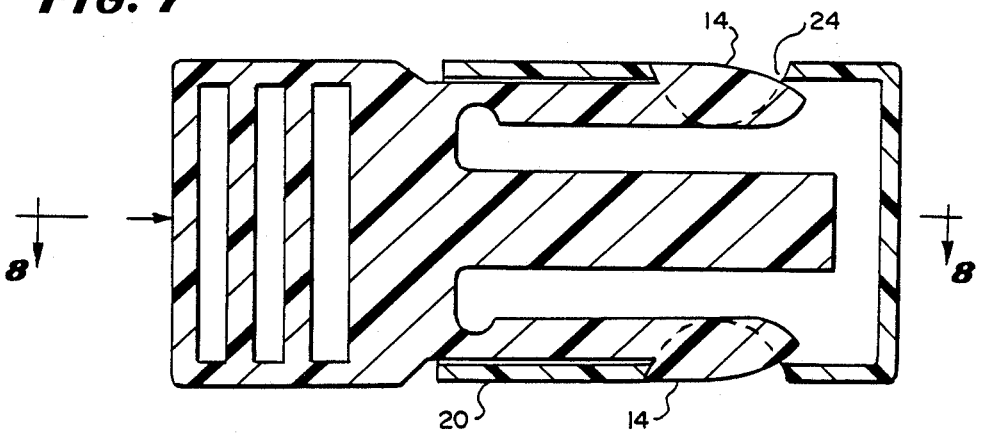
FIG. 7 is a cross-sectional view of fully engaged portions of the invention taken in the plane of line 4—4 of FIG. 3.
Figure 8:
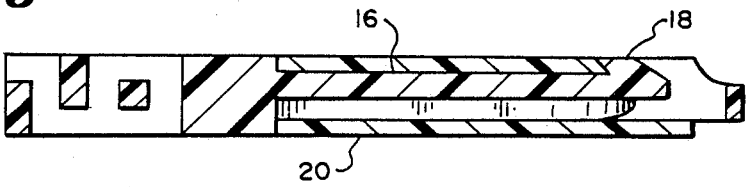
FIG. 8 is a cross-sectional view of fully engaged portions of the invention taken along line 8—8 of FIG. 7.
Figure 9:
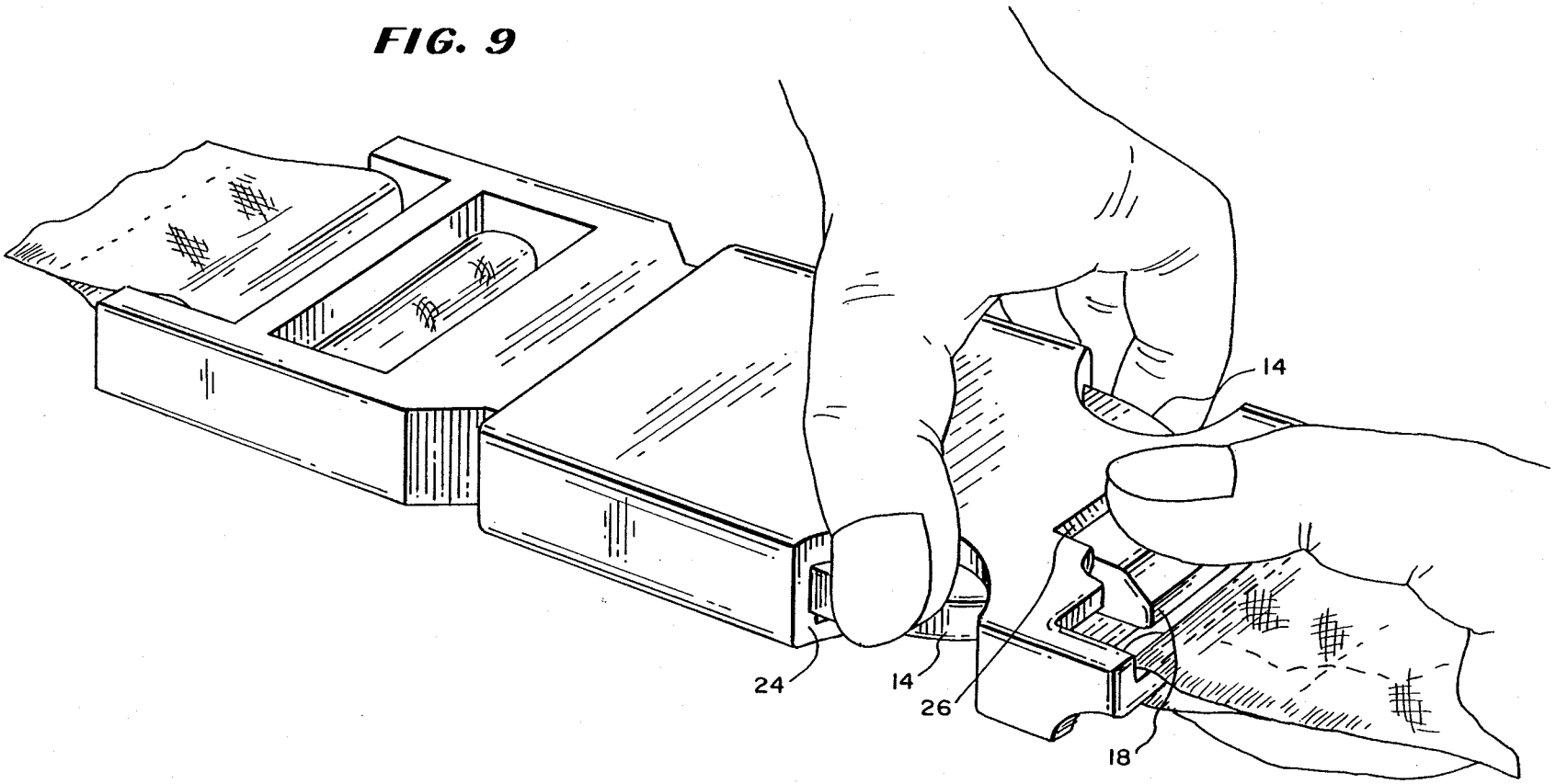
FIG. 9 is a pictorial view of the invention showing the use of two hands to simultaneously depress the latches and hook of the portions so as to permit disengagement of the portions.

FIG. 1 shows the fully engaged portions of the invention. In the preferred embodiment, the invention is being utilized as a buckle joining two straps together. One portion, 10 (FIG. 2), has lateral, outward flexing, latching arms, 12. Each outward flexing, latching arm has attached to its leading edge a tab, 14. Located between the outward flexing latching arms is a flexible safety latching arm, 16, which has attached to its heading end a latching hook, 18. As can be seen in FIGS. 3, 6 and 8, the hook forms an acute angle with the body of the arm and the receiving slot (26) is designed to conform with the shape of the hook to increase holding strength. The tabs 14 and latching hook 18 permit slight flexion of the arms upon insertion into the other portion 20 (see FIG. 5). When the portions are fully engaged, the tabs 14 lock into corresponding opener 24 in the receptacle portion 20 (FIGS. 1 and 7), whereas the hook of the safety arm locks into a corresponding slot 26 located in the back of the other portion (FIGS. 1 and 8). The corresponding openings 24 for the lateral outward flexing arms are located on opposite sides of the receptacle portion, 20, where the openings 24 and slot 26 permit disengagement of the portions by manually depressing the tab and safety hook. As can be seen by FIG. 9, the position of the openings 24 and slot 26 encourage the use of both hands to accomplish simultaneous depression of the lateral outward flexing arms and the center safety arm so to permit disengagement of the portions.

What I claim is:

1. A child proof safety buckle requires the use of two hands comprising:

a female portion;

a male portion for releasably engaging said female portion;

a resilient lateral latching arm located on each side of said male portion, each of said latching arms having a latching tab on the outer side thereof;

a latch opening formed in each side of said female portion to receive an associated one of said latching tabs, said resilient latching arms flexing outwardly toward the sides to cause said latching tabs to protrude into said latch openings;

a resilient central latching arm located between said lateral latching arms;

a latching hook on said central latching arm extending transversely to the plane of said latching arms; and a slot formed in said female portion to receive said latching hook upon flexing of said central latching arm by insertion of said male portion into said female portion, in order to provide a safety feature that prevents accidental or undesired opening of the buckle.

2. A buckle as defined in claim 1; wherein, said latching tabs and said latching hook are manually forced out of said receiving opening and slot for disconnection of said portions.

3. A buckle as defined in claim 1; wherein said latching tabs and said latching hook are forced out of said receiving opening and slot for disconnection, and wherein said receiving openings and slot are so positioned so as to require the simultaneous use of both hands to disengage said latching tabs and hook.

4. A child proof safety buckle requires the use of two hands comprising:

a female portion;

a male portion for releasably engaging said female portion;

a central resilient latching arm located on each side of said male portion, each of said latching arms having a latching hook on the outside thereof;

a latching slot formed in each side of said female portion to receive an associated one of said lateral latching hooks upon outward flexing of said lateral arms when said portions are engaged;

a resilient central latching arm located between said lateral latching arms;

a central latching hook on said central latching arm extending transversely to the plane of said latching arm;

a slot formed in said female portion to receive said central latching hook upon flexing of said central latching arm by insertion of said male portion into said female portion in order to provide a safety feature that prevents accidental or undesired opening of the buckle.

5. A buckle as defined in claim 4; wherein, said latching hooks are manually forced out of said receiving slots for disconnection of said portions.

6. A buckle as defined in claim 4; wherein, said latching hooks are manually forced out of said receiving slots for disconnection of said portions, and wherein said slots are positioned so as to require the simultaneous use of both hands to disengage said latching hooks.

7. A child proof safety buckle requires the use of two hands comprising a connector for straps and belts including a safety interlock feature and comprising:

first and second releasable interlocking portions;

said first portion having a pair of outwardly flexing latching arms, each of said arms having a latching tab on the outer side thereof;

said second portion having a pair of latch openings formed therein to receive said latching tabs, said latching tabs being manually forced out of said latch openings for disconnection of said portions;

a flexible safety latching arm located in one of said portions, said safety latching arm having a latching hook extending transversely to said latching tabs; and a slot formed in the other of said portions to receive said latching hook when said portions are engaged, locking said portions together, said latching hook being manually forced out of said slot for disconnection;

said latch openings and slot being so positioned so as to require the simultaneous use of both hands to disengage said latching hook and said latching tabs to minimize accidental or unauthorized disconnection of said portions.

* * * * *